United States Patent [19]

Kemp, Jr. et al.

[11] Patent Number: 4,787,561

[45] Date of Patent: Nov. 29, 1988

[54] FINE GRANULAR METALLIC POWDER PARTICLES AND PROCESS FOR PRODUCING SAME

[75] Inventors: Preston B. Kemp, Jr., Athens; Robert J. Holland, Sr., Sayre, both of Pa.

[73] Assignee: GTE Products Corporation, Stamford, Conn.

[21] Appl. No.: 896,150

[22] Filed: Aug. 13, 1986

[51] Int. Cl.[4] ..... B02L 23/00

[52] U.S. Cl. ..... 241/30; 75/5 R

[58] Field of Search ..... 241/30, 170, 172, 199.7; 75/5 R

[56] References Cited

U.S. PATENT DOCUMENTS 3,329,348 7/1967 Pootmans ..... 241/172 X 3,591,362 7/1971 Benjamin ..... 241/172 X

FOREIGN PATENT DOCUMENTS 70205 4/1982 Japan ..... 241/172

1131535 12/1984 U.S.S.R. .

*Primary Examiner*—Timothy V. Eley

*Attorney, Agent, or Firm*—Donald R. Castle; L. Rita Quatrini

[57] ABSTRACT

Powder particles and a process for producing the particles are disclosed. The particles are of a ductile and/or malleable material which can be metal, metal alloy, or metal-ceramic composites having a substantially granular appearance and an aspect ratio of from greater than 1 to about 50 and a mean particle size of less than about 20 micrometers in diameter. The process involves grinding the above described material with the grinding media being placed in a mill so that the media are in close proximity to one another to produce a densely packed state which results in the above described powder particles being produced.

6 Claims, 3 Drawing Sheets

FINE GRANULAR METALLIC POWDER PARTICLES AND PROCESS FOR PRODUCING SAME

BACKGROUND OF THE INVENTION

This invention relates to fine granular metallic powder particles of a ductile and/or malleable material and to the process for producing the particles. More particluarly it relates to powder particles having an aspect ratio of from greater than 1 to about 100 and a means particle size of less than about 20 micrometers in diameter. More particularly, the process involves a grinding technique in which the grinding media are constrained to remain in a high density packed state.

Prior art methods of attritor, rotary, or vibratory ball milling produce very flaky high aspect ratio material which is difficult to feed to a plasma jet because of its low packing density and particle morphology.

It is desirable to produce a granular material because granular morphology results in a material with substantially higher bulk density and feeds to a plasma jet with greater ease, that is, a with a higher feed rate than non-granular or flaky material. The granular morphology also allows the material to be used in milled form for press and sinter applications including permanent metal filters.

SUMMARY OF THE INVENTION

In accordance with one aspect of this invention there is provided powder particles made of a ductile and/or malleable material which can be a metal, metal alloy, or metal-ceramic composite material. The particles have a substantially granular appearance and an aspect ratio of from greater than 1 to about 50 and a mean particle size of less than about 20 micrometers in diameter.

In accordance with another aspect of this invention, there is provided a process for producing the above described particles. The process involves grinding the above described material with the grinding media being placed in a mill so that the media are in close proximity to one another to produce a densely packed state which results in the above described powder particles being produced.

DETAILED DESCRIPTION OF THE INVENTION

For a better understanding of the present invention, together with other and further objects, advantages and capabilities thereof, reference is made to the following disclosure and appended claims in connection with the above described figures and description of some of the aspects of the invention.

According to one aspect of this invention, powder particles are produced which have substantially smooth surfaces and an aspect ratio of from greater than 1 to about 100 and a mean particle size of less than about 20 micrometers in diameter. The powder particles are a ductile and/or malleable material which can be metal, metal alloy, or metal-ceramic composites. The preferred materials are iron and iron alloys, low alloy steel, and stainless steels. By aspect ratio is meant the ratio of the length to the thickness, or, expressed another way the ratio of the maximum dimension to the minimum dimension.

In actuality the morphology of the particles of this invention falls between that of spheres and that of flakes. Spheres have an aspect ratio of 1. Flakes are relatively flat particles, having a relatively high aspect ratio which is typically greater than about 100. The aspect ratio of the particles of this invention is relatively low, that is, typically from greater than 1 to about 100, more typically from greater than 1 to about 50 and most typically from greater than 1 to about 4.

Figure 1A:
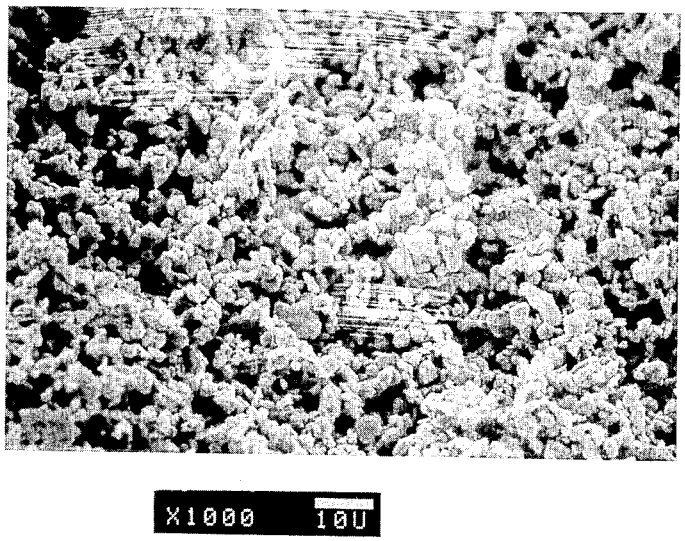
FIG. 1*a* is an SEM photograph of the material produced by the process of the present invention at a magnification of about 1000×.
Figure 1B:
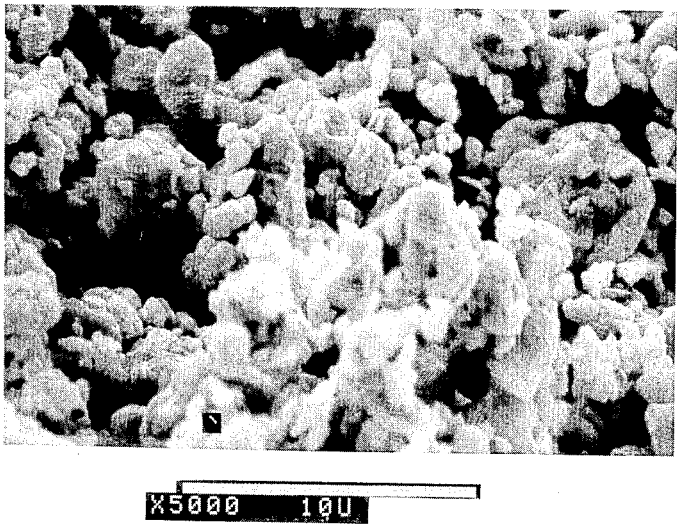
FIG. 1*b* is an SEM photograph of the material produced by the process of the present invention at a magnification of about 5000×.

FIG. 1*a* and 1*b* are SEM photograph showing the particles of this invention. It can be seen that the particles typically have a relatively low aspect ratio.

The mean particle size as used in this invention is less than about 20 micrometers by micromerograph size analysis, an air settling technique. The particles are characterized by a granular generally roughly equiaxed morphology, that is, a low aspect ratio.

The surface area as measured by Brunauer, Emmett, and Teller (BET) analysis of the particles of this invention is much greater than that of spherical particles of the same mean particle size but much less than that of powder having a flaky morphology.

The bulk density of the particles of this invention is higher by about 3 to 8 times, than a particulate material having a flaky morphology. The bulk density is about 75% of the bulk density of spherical particles of the same composition and mean particle size.

The particles of this invention are characterized by a higher level of flowability and easier feeding to a plasma jet than flaky material. This is advantageous for subsequent processing, such as by plasma melting and rapid solidification processes.

The particular morphology and size of the particles of this invention are superior properties for the production of sintered metallic powder filters, such as service life and particulate capture. The particles are small and have a tortuous surface which allows for the entrapment of very fine particles and high entrapment efficiency while maintaining a minimum filter thickness to minimize filter back pressure.

In accordance with another aspect of this invention, a process is described for producing the above described particles. This process involves specific grinding parameters and grinding environment.

In accordance with one embodiment of this process, a starting material which can be metals, metal alloys, or metalceramic composites, is ground with grinding media which are highly packed. This means that the milling media are in close proximity to each other. During grinding, the media motion is constrained to produce a high packing density state in the grinding zone. The speed of agitation isrelatively low. The actual speed depends on factors as the size and design of the mill, the nature of the material being milled, nature of the milling media, etc. The criterion for speed is that the speed must be sufficiently slow to accomplish shearing and true attrition as opposed to impact. In accordance with a preferred embodiment, with a Union Process 1-S attritor mill with a capacity of from about 1 to 1½ gallons and with about 35 to 65 kg of ¼" tungsten carbide balls with n-hexane as the milling fluid, and a powder charge of about 2.5 kg, for example, of an iron alloy, a typical mill speed is in the range of from about 140 to about 160 rpm. At the start of the grinding operation a relatively higher speed can be used to convert the material to flakes. The mill speed is then decreased to speeds as described in the above range to produce the granular morphology. Lower speeds prevent lofting of the material and grinding media, thus encouraging both to reside at the bottom of the mill. This statistically encourages more collision events and enhances grinding while promoting a more granular morphology. The combination of high packing of the grinding media and relatively low agitator speed leads to particle size reduction through a combination of shear and true attrition (wear particle generation) of the particles and produces fine particles having a granular morphology. This is unlike conventional attritor milling techniques in which size reduction is accomplished solely by media impact. Reduction of agitator speed during grinding either continually during the operation or in a series of one or more discrete changes in speed contributes to increasing the packing density of the grinding media.

The media can be tungsten carbide, stainless steel, or other materials chemically compatible with the milling fluid and the material being milled. Tungsten carbide is the most preferred.

Figure 2:
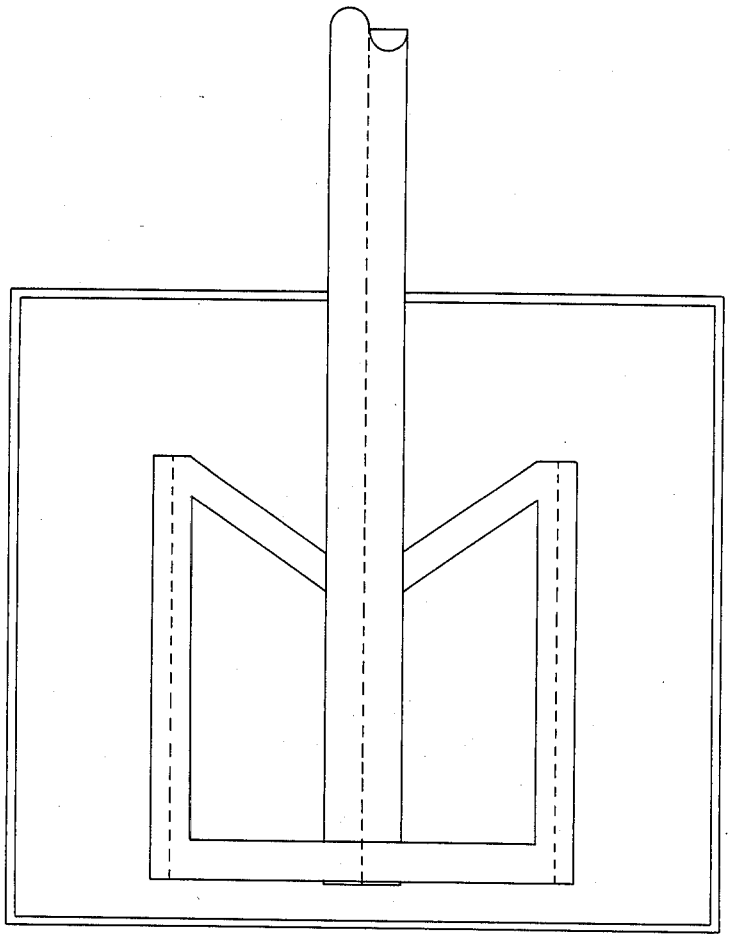
FIG. 2 is a diagram of a preferred agitator design used in the grinding process of the present invention.
Figures 3A, 3B:
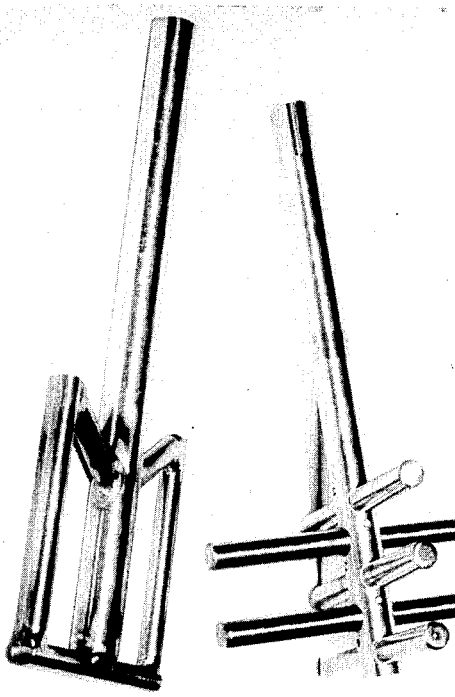
FIG. 3*a* is a photograph of the agitator of FIG. 2.
FIG. 3*b* is a photograph of a conventional Union Process agitator which can be used in the process of the present invention.

The agitator can have one or more shafts and two or more arms attached to each shaft, with the arms being parallel to each other. FIG. 2 shows an attritor mill agitator design in which two arms (A) are attached to one shaft (B) by connecting arms (C). The arms are parallel to the shaft. FIG. 3*a* is a photograph of this agitator. When two shafts are used they rotate counter to one another. FIG. 3*b* shows an attritor mill agitator having one shaft with five arms attached to the shaft. The arms are perpendicular to the shaft. This is the design of the conventional Union Process agitator manufactured by Union Process Incorporated.

In accordance with another embodiment, the high packing density of the media can be accomplished by means of a plate which rests on the media and is either free to rotate or is attached to a shaft in an attritor mill. The plate applies a force to the grinding media either through gravity or mechanical action, constraining media motion and attaining a higher packing density in the bed of media. Another way to constrain upward media motion is to use a relatively long column of media. Use of a longer column of media results in increased downward force on the media at the bottom of the mill, thus accomplishing essentially the same thing as a plate on a shorter column. Use of either of the above described methods to increase downward force in the mill can allow the use of less dense milling media. For example, tungsten carbide can be replaced by less dense stainless steel which is less expensive than tungsten carbide and sometimes more compatible with the material being milled.

A grinding fluid is selected with physical and chemical properties such that the powder settles to the dense zone of media at the bottom of the mill. For example, alkane hydrocarbons such as n-hexane and n-heptane, are preferred solvents. Chlorinated solvents can be used if the material does not contain metals which react with the solvent.

To more fully illustrate this invention, the following nonlimiting example is presented. Example A combination of parameters and environment in a ball attritor mill, (Szeigvari type) produces fine high bulk density powders from ductile metals with a granular equiaxed (length/diameter ratio of less than about 4) morphology. The starting feed material can be coarse gas or water atomized prealloyed powders. By milling in n-hexane or similar organic solvent with tungsten carbide or other high density media, at a low speed, the metallic powder settles to the bottom of the mill, where milling occurs. Milling occurs primarily by shearing and true attrition (wear and debris particle generation) rather than by impact. A typical powder resulting from this type of milling is:

316 L Stainless steel
Surface area: $0.51 m^2/g$
Size (average): 11.1 micrometer
<10 micrometers: 59.4%
<20 micrometers: 85.9%
Starting powder: −200 mesh gas atomized 316 L stainless steel.

While there has been shown and described what are at prsent considered the preferred embodiments of the invention, it will be obvious to those skilled in the art that various changes and modifications may be made therein without departing from the scope of the invention as defined by the appended claims.

What is claimed is:

1. A process for producing powder particles of a ductile and/or malleable material selected from the group consisting of metals, metal alloys, and metal-ceramic composites, said process comprising net grinding with grinding media, a starting ductile particulate material selected from the group consisting of metals, metal alloys, and metal-ceramic composites with the grinding media being placed in a mill so that said media are in close proximity to one another and thereby resulting in a densely packed state to produce said powder particles wherein said powder particles are characterized by a substantially granular appearance and an aspect ratio of from greater than 1 to about 100 and a mean particle size of less than about 20 micrometers in diameter.

2. A process of claim 1 wherein said grinding is done in an attritor mill.

3. A process of claim 2 wherein said grinding is done in an attritor mill having one or more shafts with 2 or more agitating arms attached to each shaft, said arms being parallel to said shafts.

4. A process of claim 2 wherein said mill has a plate resting freely on said media.

5. A process of claim 1 wherein said aspect ratio is from greater than 1 to about 50.

6. A process of claim 5 wherein said aspect ratio is from greater than about 1 to about 4.

* * * * *